US006412776B1

(12) United States Patent
Baxter et al.

(10) Patent No.: US 6,412,776 B1
(45) Date of Patent: Jul. 2, 2002

(54) GAME APPARATUS

(76) Inventors: Derek Nigel Baxter, 50 Egerton Street, New Brighton, Wirral Merseyside CH45 2LT; Alan John Baxter, 16 Ashville Road, Claughton, Birkenhead Mersey L43 8SA, both of (GB)

( * ) Notice: Subject to any disclaimer, the term of this patent is extended or adjusted under 35 U.S.C. 154(b) by 0 days.

(21) Appl. No.: 09/269,216

(22) PCT Filed: Jul. 23, 1997

(86) PCT No.: PCT/GB97/01985

§ 371 (c)(1),
(2), (4) Date: Mar. 15, 2001

(87) PCT Pub. No.: WO98/03237

PCT Pub. Date: Jan. 29, 1998

(30) Foreign Application Priority Data

Jul. 23, 1996 (GB) ..... 9615390

(51) Int. Cl.[7] ..... A63F 3/02
(52) U.S. Cl. ..... 273/242; 273/260
(58) Field of Search ..... 273/260–262, 273/255, 248, 242

(56) References Cited

U.S. PATENT DOCUMENTS

| | | | | | |
|---|---|---|---|---|---|
| 3,761,093 | A | * | 9/1973 | Migliore | 273/260 |
| 3,820,791 | A | * | 6/1974 | Powers | 273/260 |
| 3,989,253 | A | * | 11/1976 | Schifman | 273/260 |
| 4,300,768 | A | * | 11/1981 | Wechsler | 273/260 |
| 4,984,807 | A | * | 1/1991 | Shiryon | 273/262 |
| 5,351,965 | A | | 10/1994 | Telfer et al. | 273/260 |
| 6,250,633 | B1 | * | 6/2001 | Mohtasham et al. | 273/261 |

FOREIGN PATENT DOCUMENTS

| | | |
|---|---|---|
| GB | 321 219 | 3/1929 |
| GB | 2 033 239 A | 6/1979 |
| GB | 2 187 105 A | 1/1987 |

* cited by examiner

*Primary Examiner*—Benjamin H. Layno
(74) *Attorney, Agent, or Firm*—Dykema Gossett PLLC

(57) ABSTRACT

A game apparatus comprises a playing surface in which a plurality of different playing space types are arranged on a grid. The playing space type determining the number of spaces a playing piece may progress from that square in a subsequent move.

11 Claims, 2 Drawing Sheets

GAME APPARATUS

The present invention relates to a game apparatus, for example, a board game apparatus.

BACKGROUND OF THE INVENTION

Many games, for example games of strategy, such as for example, Chess and Draughts are played on a playing surface comprising a grid.

In a game, for example, Chess or Draughts, playing pieces move about the playing surface in accordance with a set of rules. The type of the playing piece determines the type of move the playing piece can make on the playing surface.

SUMMARY OF THE INVENTION

It is an aim of the present invention to provide a playing surface which will enable a novel game of strategy to be played thereon.

This aim has been met by the provision of a playing surface consisting of a plurality of different playing space types wherein each playing space type determines the type of move a playing piece may make from that space in a subsequent move.

For example, the type of move may be limited to the number of spaces the piece may progress and/or the direction of travel.

According to the present invention there is provided a game apparatus comprising a playing surface consisting of a plurality of different playing space types wherein each playing space type determines the type of move a playing piece may make from that space in a subsequent move.

Preferably the playing space type determines the number of spaces a playing piece may progress and/or the direction of travel.

Preferably, the playing spaces are arranged on a grid which more preferably still comprises the same number of ranks and files.

More preferably still the playing surface comprises an odd number of ranks and files such that the playing surface has a single central playing space.

More preferably still the preferred playing surface will comprise eighty one playing spaces arranged in a grid of nine ranks and nine files.

Preferably the playing surface will have a plurality, i.e. at least two, of differently differentiated playing spaces, each differently differentiated playing space determining a different type of move a playing piece positioned thereon can make.

Preferably, there are three differently differentiated playing spaces.

More preferably still, the differently differentiated playing spaces determine the number of spaces a playing piece positioned on the playing space can move.

Thus, for example, where the playing surface has three differently differentiated playing spaces these would determine three different move types, such as for example a one space move, a two space move and a three space move. The move may, for example, be a vertical, horizontal or a diagonal move.

In the case of a playing surface comprising a nine by nine grid and having three different types of playing spaces, there are preferably;

a) 25 playing spaces denoting a first type of move, for example, a three space move;

b) 32 playing spaces denoting a second type of move, for example, a two space move; and c) 24 playing spaces denoting a third type of move, for example, a one space move.

These three differently differentiated playing spaces are preferably arranged about the playing surface in an ordered manner as follows:

Assuming the left hand square of a nine by nine arid is denoted Al and the ranks are numbered 1 to 9 and the files A to I, the playing spaces or squares are denoted as follows:

Spaces denoting a first type of move:

A1, A3, A5, A7, A9,
C1, C4, C6, C9,
D3, D7,
E1, E5, E9,
F3, F7,
G1, G4, G6, G9,
I1, I3, I5, I7, I9,

Spaces denoting a second type of move:

A2, A4, A6, A8,
B1, B3, B5, B7, B9,
C2, C8,
D1, D5, D9,
E2, E4, E6, E8,
F1, F5, F9,
G2, G8,
H1, H3, H5, H7, H9,
I2, I4, I6, I8,

Spaces denoting a third type of move:

B2, B4, B6, B8,
C3, C5, C7,
D2, D4, D6, D8,
E3, E7,
F2, F4, F6, F8,
G3, G5, G7,
H2, H4, H6, H8,

As well as the playing surface, a game apparatus may have a plurality of playing pieces.

For a playing surface comprising a nine by nine grid, it is preferred that there are two sets of playing pieces (one for each player), each set comprising ten playing pieces. Each set of pieces is a different color and comprises five first or "higher" pieces and five second or "lower" pieces, the higher pieces being different, e.g. larger in size, than the lower pieces.

Of course it would be possible to produce a larger playing surface, for example one of thirteen ranks by thirteen files for four players.

BRIEF DESCRIPTION OF THE DRAWINGS

The invention will be further described by way of example only, with reference to the following figures, in which.

DETAILED DESCRIPTION OF THE PREFERRED EMBODIMENT

Figure 1:
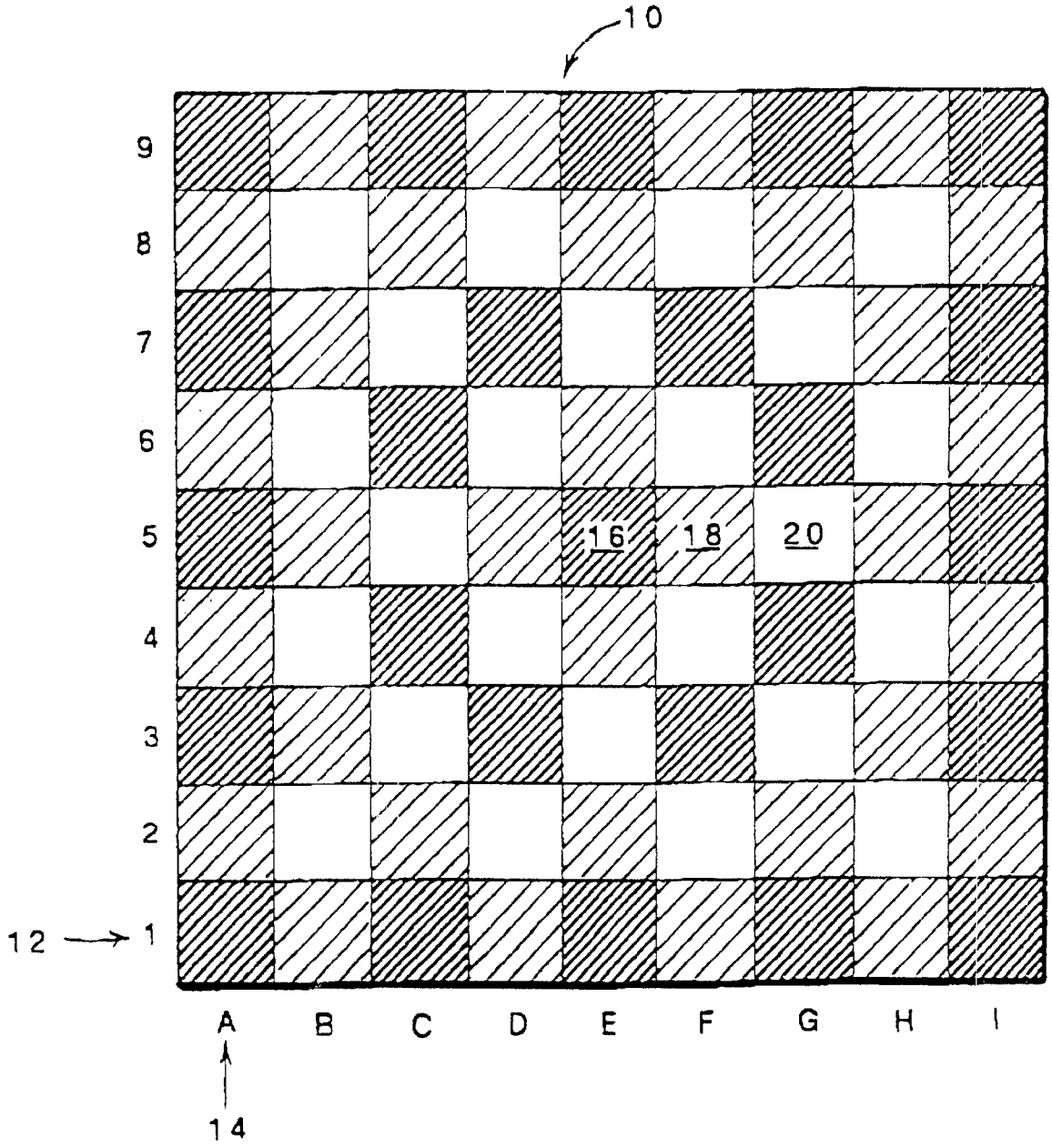
FIG. 1 illustrates in plan view a preferred embodiment of a playing surface according to the present invention.
Figure 2:
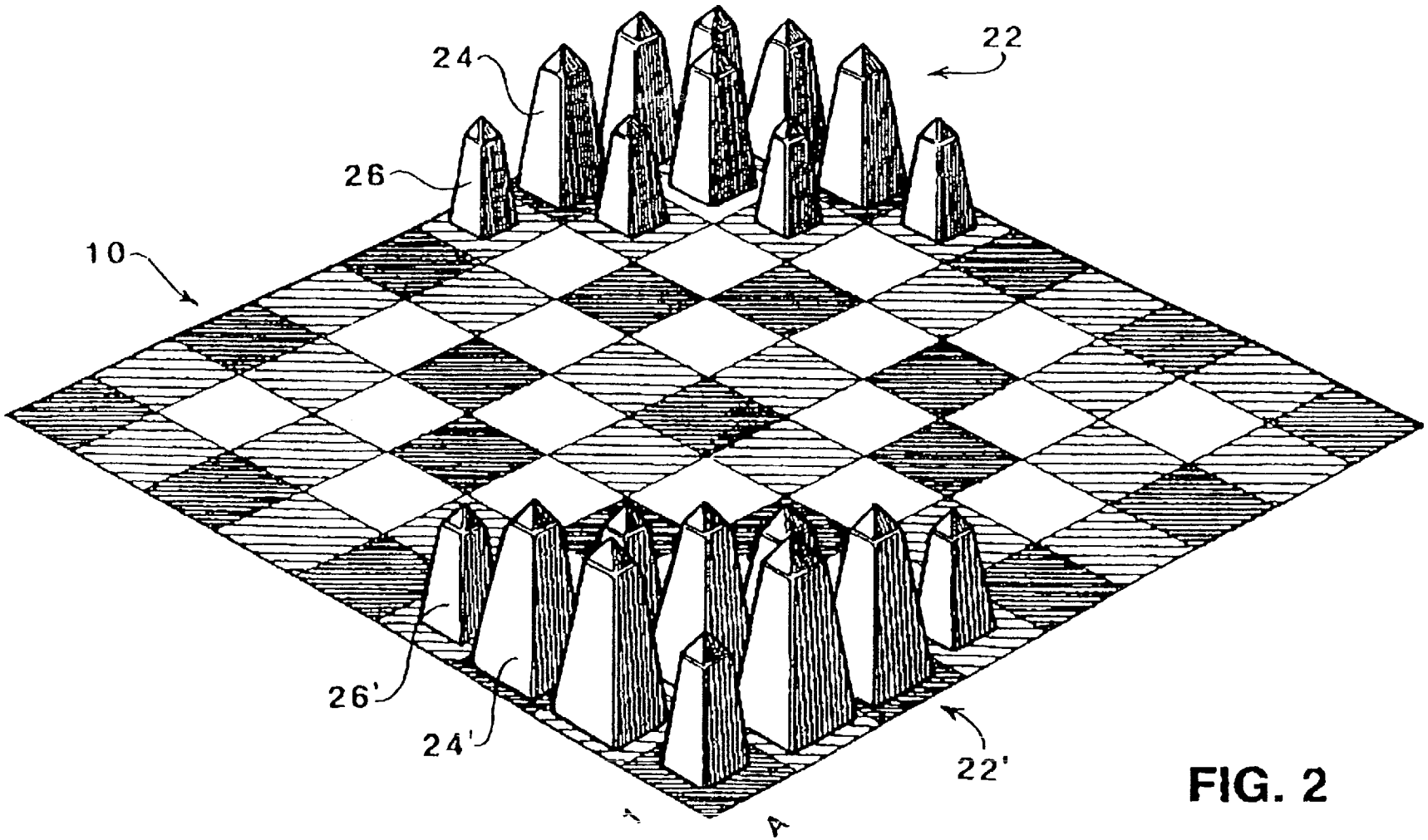
FIG. 2 illustrates the playing surface of FIG. 1, with playing pieces positioned thereon.

The preferred playing surface 10 of FIGS. 1 and 2 comprises a grid comprising nine ranks 12, (numbered rank 1,2,3,4,5,6,7,8 and 9) and nine files 14 (lettered A,B,C,D, E,F,G,H and I).

The grid comprises three differently differentiated playing space types 16, 18 and 20.

There are twenty five type 16 spaces, which are preferably shaded or coloured dark, for example black, and are positioned on playing spaces:

A1, A3, A5, A7, A9,
C1, C4, C6, C9,
D3, D7,
E1, E5, E9,
F3, F7,
G1, G4, G6, G9,
I1, I3, I5, I7, I9.

These spaces denote a first type move of three spaces (horizontally, vertically or diagonally)

There are thirty two type 18 spaces, which are preferably shaded or coloured with a mid-shade or colour, for example grey, and are positioned on playing spaces:

A2, A4, A6, A8,
B1, B3, B5, 87, B9,
C2, C8,
D1, D5, D9,
E2, E4, E6, E8,
F1, F5, F9,
G2, G8,
H1, H3, H5, H7, H9,
I2, I4, I6, I8.

These spaces denote a second type move of two spaces (horizontally, vertically or diagonally)

There are twenty four type 20 spaces, which are preferably shaded or coloured light, for example white, and are positioned on playing spaces:

B2, B4, B6, B8,
C3, C5, C7,
D2, D4, D6, D8,
E3, E7,
F2, F4, F6, F8,
G3, G5, G7,
H2, H4, H6, H8.

These spaces denote a third type move of one space (horizontally, vertically or diagonally)

As well as a playing surface, a board game apparatus additionally comprises two sets, 22, 22' of playing pieces, comprising five first or "higher" playing pieces 24,24' and five second or "lower" playing pieces 26,26'. In the preferred embodiment the "higher" playing pieces 24,24' are larger variations of the identically shaped "lower" playing pieces 26,26'. Alternatively the higher and lower playing pieces can differ in some other desired way.

The layout of the playing surface enables a game of strategy according to the following method to be played.

The playing pieces 24, 24', 26, 26' are set up in diagonally opposing corners of the playing surface as illustrated in FIG. 2.

Thus the five lower pieces 26' of one set 22' are placed on playing spaces A1, A4, B3, C2 and D1 and the five higher pieces 24' placed on playing spaces A2, A3, B1, B2 and C1.

The five lower pieces 26 of the other set 22 are placed on playing spaces I9, I6, H7, G8 and F9 and the five higher pieces 24 placed on playing spaces I8, I7, H9, H8 and G9.

Since the playing surface is symmetrical, it would however be possible to set the apparatus up from the corner A9 and I1.

One game of strategy, of a type played on the playing surface of the invention illustrated in the embodiment described with reference to FIGS. 1 and 2 could be played as follows:

One piece is moved per turn. Players take alternate turns. All pieces have the same power of movement and capture—the position of a piece on the playing area dictates how far it can move, as follows:

A piece on a white square can move to any adjoining square.

A piece on a grey square can move two squares in a straight line, horizontally, vertically or diagonally.

A piece on a black square can move three squares in a straight line, horizontally, vertically or diagonally.

A piece must make its full move, for example a piece on a black square can never move only two squares, it must move three. When the piece has been moved, the colour of the square it lands on will dictate how far it can move from that square in a subsequent turn.

Any piece in movement may jump over any other piece in its path without affecting the other piece. Two pieces must never occupy the same square.

Any playing piece may capture any other playing piece. Moving a playing piece onto a square occupied by an opponent's piece captures that piece. Captured pieces are removed from the playing area and play no further part in the game.

A game is won by capturing any four of your opponent's higher pieces.

Whilst the playing surface of the present invention has been illustrated with reference to a game being played between two people on a playing surface comprising eighty-one squares with two sets of playing pieces in the form of obelisks, it will be appreciated by one skilled in the art a number of game forms can be played on a playing surface embodying the principle of the invention.

The playing surface may be produced on a board, games table or electronic screen by means of a computer programme.

What is claimed is:

1. A game apparatus comprising a playing surface comprising:

grid of playing spaces consisting of an odd number of ranks and files of playing spaces, each of said playing spaces divided into a plurality of different playing space types, each playing space type having a distinguishing indicium corresponding to the number of playing spaces a playing piece may move, wherein a first type of playing space having a first indicium requiring a playing piece landing thereon to move only one space in a subsequent turn, a second type of playing space having a second indicium requiring a playing piece landing thereon to move exactly two spaces in a subsequent turn, and a third type of playing space having a third indicium requiring a playing piece landing thereon to move exactly three spaces in a subsequent turn.

2. A game apparatus as claimed in claim 1 wherein the grid comprises nine ranks and nine files.

3. A game apparatus as claimed in claim 2 wherein there are:

25 playing spaces denoting a first type of move;

32 playing spaces denoting a second type of move; and 24 playing spaces denoting a third type of move.

4. A game apparatus as claimed in claim 2 wherein the playing spaces are arranged as follows:

spaces denoting a first type of move:

A1, A3, A5, A7, A9,
C1, C4, C6, C9,
D3, D7,
E1, E5, E9,
F3, F7,
G1, G4, G6, G9,
I1, I3, I5, I7, I9 spaces denoting a second type of move:

A2, A4, A6, A8,
B1, B3, B5, B7, B9,
C2, C8,
D1, D5, D9,
E2, E4, E6, E8,
F1, F5, F9,
G2, G8,
H1, H3, H5, H7, H9,
I2, I4, I6, I8, spaces denoting a third type of move:

B2, B4, B6, B8,
C3, C5, C7,
D2, D4, D6, D8,
E3, E7,
F2, F4, F6, F8,
G3, G5, G7,
H2, H4, H6, H8.

5. A game apparatus as claimed in claim 1 wherein there are at least three playing space types.

6. A game apparatus as claimed in claim 1 which further comprises playing pieces.

7. A game apparatus as claimed in claim 6 wherein there are two sets of ten playing pieces.

8. A game apparatus as claimed in claim 7 wherein each set of ten playing pieces comprises five first pieces and five second pieces.

9. A game apparatus as claimed in claim 1 in which the playing surface is in the form of a board.

10. A game apparatus as claimed in claim 1 wherein the playing surface is displayed electronically.

11. A game apparatus as claimed in claim 1 wherein the playing surface is an integral part of a game table.

* * * * *